US005443916A

United States Patent [19]

Revankar

[11] Patent Number: 5,443,916

[45] Date of Patent: Aug. 22, 1995

[54] HARD FACING CASTING SURFACES WITH WEAR-RESISTANT SHEETS

[75] Inventor: Gopal S. Revankar, Moline, Ill.

[73] Assignee: Deere & Company, Moline, Ill.

[21] Appl. No.: 112,530

[22] Filed: Aug. 27, 1993

Related U.S. Application Data

[62] Division of Ser. No. 822,904, Jan. 21, 1992, Pat. No. 5,267,600.

[51] Int. Cl.[6] ..... B22F 3/00

[52] U.S. Cl. ..... 428/539.5; 428/552; 428/553; 428/564; 428/565

[58] Field of Search ..... 428/539.5, 551, 552, 428/553, 564, 565, 568, 569

[56] References Cited

U.S. PATENT DOCUMENTS

| | | | |
|---|---|---|---|
| 1,978,319 | 10/1934 | Mowery | 164/97 |
| 2,339,270 | 1/1944 | Kelleher | 51/309 |
| 2,874,429 | 2/1959 | Emter et al. | 164/111 |
| 3,102,329 | 9/1963 | Horn et al. | 29/182.3 |
| 3,245,826 | 4/1966 | Luce et al. | 117/47 |
| 3,291,578 | 12/1966 | Fahey | 29/195 |
| 3,372,469 | 3/1968 | Langrod | 29/573 |
| 3,392,439 | 7/1968 | Sonnenschein | 29/573 |
| 3,506,498 | 4/1970 | Langrod | 136/237 |
| 3,507,634 | 4/1970 | O'Driscoll | 29/191.4 |
| 3,594,237 | 7/1971 | Sonnenschein | 136/227 |
| 3,707,429 | 12/1972 | Saunders | 161/116 |
| 3,831,258 | 8/1974 | Elbert et al. | 29/420 |
| 3,880,674 | 4/1975 | Saunders | 136/237 |
| 4,119,459 | 10/1978 | Ekemar et al. | 75/243 |
| 4,556,389 | 12/1985 | Ueno et al. | 433/206 |
| 4,608,318 | 8/1986 | Makrides et al. | 428/553 |
| 4,646,811 | 3/1987 | Morishita et al. | 164/103 |
| 4,764,434 | 8/1988 | Aronsson et al. | 428/565 |
| 5,027,878 | 7/1991 | Revankar et al. | 164/98 |
| 5,126,212 | 6/1992 | Yamada et al. | 428/547 |

FOREIGN PATENT DOCUMENTS

| | | |
|---|---|---|
| 297552 | 1/1989 | European Pat. Off. . |
| 51-25211 | 7/1976 | Japan . |
| 53-26565 | 8/1978 | Japan . |
| 58-192671 | 11/1983 | Japan . |
| 60-21306 | 2/1985 | Japan . |
| 62-199256 | 9/1987 | Japan . |
| 2074912 | 11/1981 | United Kingdom . |
| 1163977 | 1/1985 | U.S.S.R. . |

OTHER PUBLICATIONS

Hansen et al, "Applications of Cast-On Ferrochrome-Based Hard Surfacings to Polystyrene Pattern Castings", Bureau of Mines Investigations 8942, U.S. Dept. of Interior, 1985, pp. 1-37.

*Primary Examiner*—Donald P. Walsh
*Assistant Examiner*—Chrisman D. Carroll
*Attorney, Agent, or Firm*—Burns, Doane, Swecker & Mathis

[57] ABSTRACT

A method for impregnating a metal product with a hard wear-resistant surface area comprises providing a wear-resistant layer in the form of a sintered sheet having at least one "pin" integrally attached onto a surface of the sheet. This wear-resistant layer is attached onto the sand core and a metal melt is cast so as to produce the final product. This method can be used to produce a variety of metal products although cast iron, and in particular, ductile iron are preferred. Moreover, this process can effectively employ any of the hard phases which can be sintered, e.g., tungsten carbide, chromium carbide, and the like. Preferably, both the sheet and the "pins" are made from the same mixture of a wear-resistant material, an organic binder, and at least one plasticizer.

11 Claims, 2 Drawing Sheets

HARD FACING CASTING SURFACES WITH WEAR-RESISTANT SHEETS

This application is a divisional of application Ser. No. 07/822.904, filed Jan. 21, 1992, now U.S. Pat. No. 5,267,600.

BACKGROUND OF THE INVENTION

The present invention relates to a process for the impregnation of a metal product with a surface comprising a hard wear-resistant material.

A wide variety of techniques are known for the impregnation of metals, e.g., iron, with a hard wear-resistant surface. Such techniques include flame spray coating and plasma spray coating. However, each of these spray coating techniques suffer from problems associated with the spalling of surface layers during the coating process and during service as well as the particularly large expense associated with the use of this technique.

Cast-in-carbides are also known in which carbide particulates are placed in a mold and molten iron is then cast. See, for example, the discussion within U.S. Pat. No. 4,119,459 to Eckmar et al. It is difficult, however, with such castings to accurately maintain the carbide particles in the desired location and in a regular distribution pattern.

In addition, certain cast-on hard surfacing techniques for use with polystyrene patterns are also known in the art. See, for example, the discussion in Hansen et al., "Application of Cast-On Ferrochrome-Based Hard Surfacing to Polystyrene Pattern Castings," Bureau of Mines Report of Investigations 8942, U.S. Department of the Interior, 1985.

However, this process suffers from problems associated with the low reliability of the bond formed between the wear-resistant layer, e.g., tungsten carbide, and the foam pattern. Because of this failure, the iron may not penetrate the layer before the iron solidifies and thus, instead of impregnating the iron, the carbide spalls off the product.

The inventor of the present invention has also been involved in inventing other processes in an attempt to more effectively impregnate the surface of a metal, e.g., iron, with hard phases during the casting process. For example, attention is directed toward U.S. Pat. No. 5,027,878 to Revankar et al which relates to the carbide impregnation of cast iron using evaporative pattern castings (EPC) as well as U.S. application Ser. Nos. 564,184 and 564,185 which relate to the impregnation of cast iron and aluminum alloy castings with carbides using sand cores.

However, despite their effectiveness, these methods also have certain drawbacks. For example, the EPC method may involve the installation of special equipment in a conventional foundry. Furthermore, castings produced by this process can suffer from distortion due to the distortion of the plastic foam replicas. On the other hand, the above sand core methods of casting carbides can involve the preparation of carbide spheres which adds to the cost of the process. The cost can be further increased if a substantially flat wear-resistant surface is desired because in such a case, a surface layer equal in thickness to half the sphere diameter or more will need to be machined off.

Accordingly, the need still exists for a method of impregnating metal surfaces, and in particular iron surfaces with a hard wear-resistant material which is capable of overcoming the problems associated with known techniques.

SUMMARY OF THE INVENTION

In one aspect of the present invention, there is disclosed a method for impregnating a metal product with a hard wear-resistant material surface layer which involves the use of "pins" or "hooks" made from the wear-resistant material and which enable the wear-resistant material surface layer to be "mechanically" attached to the casting surface.

In one aspect, the present invention relates to a method for impregnating a metal product with a hard wear-resistant surface layer comprising:

(a) providing a wear resistant material layer in the form of a sintered sheet having at least one pin integrally attached to one of the surfaces thereof;

(b) attaching the wear resistant layer to a sand core; and (c) casting a metal melt so as to produce a metal product having a wear-resistant material surface layer.

In another aspect, the present invention relates to the product produced by this method.

DETAILED DESCRIPTION OF THE PREFERRED EMBODIMENTS

The present invention can be employed for casting virtually any type of metal which is known within the art. However, cast iron, and in particular, ductile or grey iron are preferred. Other examples of suitable metals include non-ferrous alloys and superalloys.

In the present invention, an initial step involves the formation of a sheet comprising a wear-resistant material. As to the choice of the hard wear-resistant material, the present invention can effectively employ any of the hard phases which can be sintered, such as tungsten carbide, chromium carbide, and the like. Furthermore, this wear-resistant material can include a metallic binder, such as those of the Fe group, preferably Co for use with tungsten carbide, or Ni for chromium carbide, and the like. For example, where ductile iron is employed as the metal to be cast, particles composing tungsten carbide with 14–17 weight % cobalt is preferred.

The sheet is formed by mixing a powder of the hard wear-resistant material (optionally containing a metallic binder) with a suitable organic binder, for example, a 10% polyvinyl alcohol (PVA) solution, and a suitable plasticizer, for example, 2-ethylhexyl diphenyl phosphate, phosphate ester plasticizer (e.g., "KRONITEX" 3600 of FMC Corporation) or a mixture of plasticizers so as to form a slip which has appropriate rheological characteristics such that it can be formed into a sheet. In this regard, suitable binders and/or plasticizers include any which can be effectively employed with the particular wear-resistant material.

In this process, fine particles of the wear resistant material are preferably employed, i.e., −140/200 and finer mesh size.

The outer surface of the sheet is then preferably patterned into a texture which allows for better impregnation into the iron. The shape of the pattern within the sheet is any pattern which will effectively prevent the lateral movement of the sheet from component surface during use, i.e., to allow it to resist any shear force that may be applied tangentially to the sheet surface. For example, in one embodiment, a "waffle" texture is patterned onto the outer surface of the sheet. See, for example, FIG. 1.

Moreover, this pattern can be formed by any suitable means, for example, by pressing a die with the required pattern onto the surface of the sheet while the sheet is still green and in the plastic state.

Figure 2:
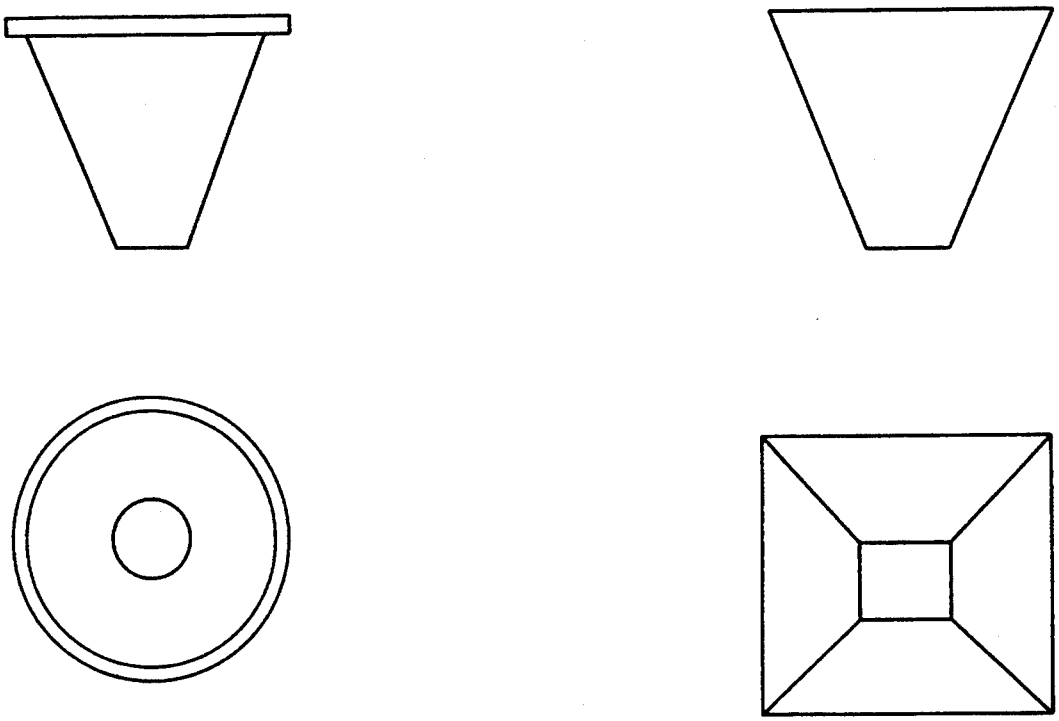
FIG. 2 illustrates suitable shapes for the carbide pins which are employed in the present invention.

The same wear-resistant material/organic binder/-plasticizer mixture employed in producing the sheet is also preferably employed in forming the "pins" or "hooks" which are to be attached to the sheets. The shape of these "pins" or "hooks" is any shape which allows it to "mechanically" hold the wear-resistant material sheet onto the casting surface. Two examples of suitable pin shapes are illustrated by FIG. 2. Other pin shapes can include, e.g., flat "sheets" of carbides, also having a waffle surface texture.

These pins are cast separately and then dried, e.g., in an oven at, e.g., 100° C. so as to become a "rigid" solid. These pins are planted onto the sheet and in particular, onto the side of the sheet containing the pattern so as to form the wear-resistant layer. See, for example, the arrangement illustrated in FIG. 1.

The number of pins which need to be attached to the sheet is that necessary to overcome the force of separation that may be applied to the sheet surface. For example, in the embodiment illustrated by FIG. 1, four hooks are employed although, the number can vary from, e.g., 1–8 pins.

These pins can be attached after they are dried, or, they can be presintered and then attached onto the sheets. In either technique, they become an integral part of the sheets when the sheets themselves are sintered along with the attached pins. These sheets are then heated at low temperatures e.g., 320°–340° C. to partially remove organic binder and plasticizer.

This sintering of the "green" sheet occurs under conditions so as to allow the sheet and the pins to become fully dense. Suitable sintering conditions are recognized in the art and include, for example, that occurring in a vacuum at 1450°–1475° C. for 50–75 minutes.

Because the composition of the pin is preferably identical to that of the sheet, the sintered sheet with the hooks attached is effectively stress-free when cooled to room temperature from the sintering temperature and thus, the pins form an integral part of the sheets subsequent to sintering. See, for example, the cross-section illustrated in FIG. 3.

Though the above described method uses binder and plasticizer to form sheets and pins there may be other methods which may not use these organic additives. Thus for example, the carbide powder with a suitable proportion of metallic binder may be directly pressed into a sheet with a flat pin in a cold die press. Such sheets may then be sintered following the same procedure as for making carbide sheets t/sing organic binders and plasticizers except, of course, that the step for removal of binder and plasticizer by heating at lower temperatures is unnecessary.

The sintered wear-resistant layer is then attached onto a suitable mold surface, e.g., a sand core by means which are recognized within the art. For example, in one embodiment, a high temperature adhesive is employed and the layer is then heated in, e.g., an oven at 100° C. so as to drive moisture from the adhesive and cure it.

By high temperature, it is meant that the adhesive has a melting point higher than the metal pouring temperature. Any suitable adhesive can be employed within the present invention with high temperature inorganic adhesive being preferred.

In the preferred embodiment employing ductile iron as the metal, the binder comprises a high temperature ceramic adhesive, AREMCO's "CERAMABOND" 569, which is a proprietary high temperature binder that includes oxides of aluminum, silicon and potassium, as a colloidal suspension in water and which has a maximum use temperature of about 1650° C. ("CERAMABOND" is a trademark of AREMCO Products, Inc.).

Figure 3:
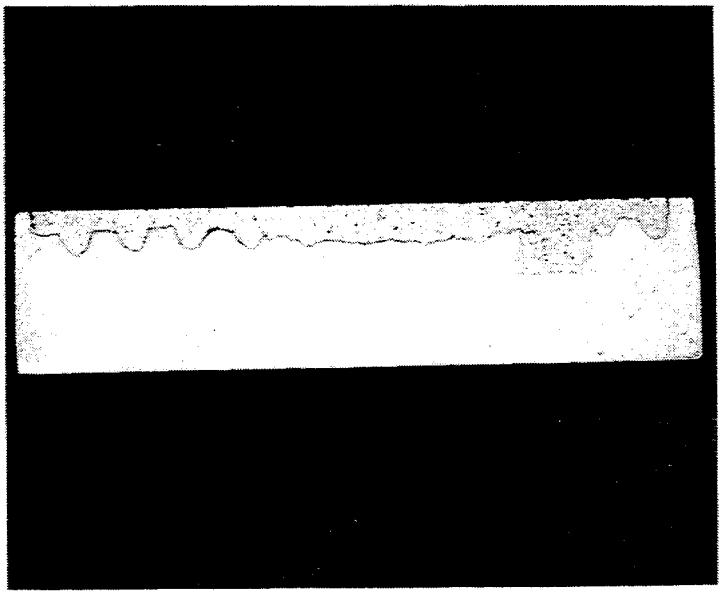
FIG. 3 is a photograph illustrating a ductile iron casting showing a carbide sheet having a "hook" or "pin" forming an integral part of the sheet.

At this point, the liquid metal is cast around the hard wear-resistant layer using any of the casting techniques traditionally employed in the art, e.g., gravity feed casting, squeeze casting, vacuum casting or the like. However, due to the ease of use, the gravity feed of metal is preferred. An exemplary ductile iron casting with tungsten carbide impregnation is illustrated in FIG. 3.

The method according to the present invention can be used to produce metal products which have a wide variety of applications. Furthermore, as discussed above, this process may be applied to a variety of metals and alloys thereof because the process does not require that the metal react metallurgically with the wear-resistant material sheet. However, in the specific case of cast iron, there is found a metallurgical reaction which further strengthens iron-carbide bonding. This reaction can be facilitated by the waffle pattern on the sheet.

Moreover, the process of the present invention can provide these products at a greatly reduced cost when compared with prior art systems. In particular, the surface modification can be effectively accomplished during the casting process without requiring any subsequent brazing or welding and without requiting additional casting facilities such as that associated with the EPC system. In fact, this process can be easily adapted to existing sand casting foundry practices.

In, order to further illustrate the present invention and the advantages associated therewith, the following specific example is given, it being understood that same is intended only as illustrated and in no wise limitative.

EXAMPLE

Figure 1:
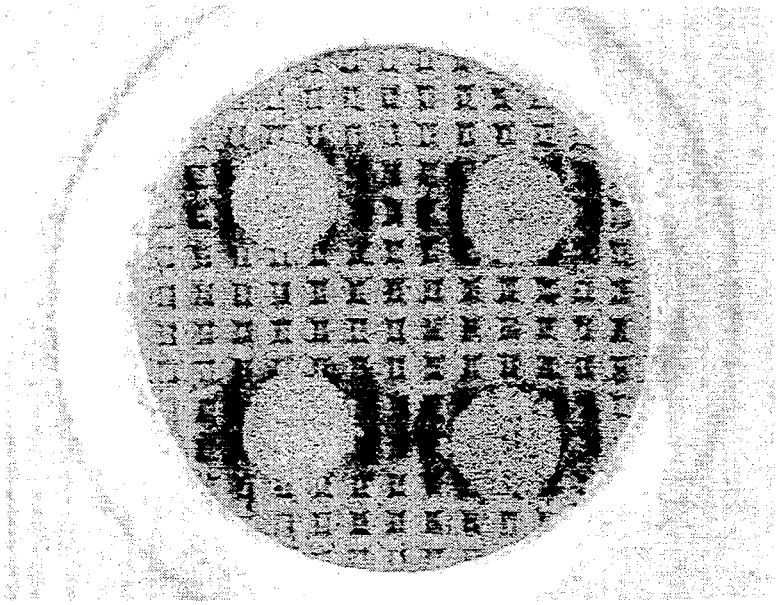
FIG. 1 illustrates a sintered carbide sheet containing four carbide "pins" according to the present invention.

Fine tungsten carbide/14–17% cobalt powder (—140/200 or finer mesh size) is mixed with a suitable binder such as a 10% aqueous polyvinyl alcohol solution and a suitable plasticizer (2-ethylhexyl diphenyl phosphate or "KRONITEX" 3600 of FMC Corporation) or a mixture of plasticizers to form a slip with appropriate rheological characteristics so it can be cast or rolled into a sheet. The sheet surface is patterned into a "waffle" texture as shown in FIG. 1, before the sheets become rigid through drying or curing.

Using the same carbide/binder/plasticizer mixture, pins of a suitable shape (see FIG. 2) are cast separately and are dried in an oven at 100° C. when they become rigid solids. These pins are planted into the above carbide sheets on the waffle pattern side of the sheet as shown in FIG. 1, while the sheets are still plastic, i.e., before the binder resin hardens. The green carbide sheets are then sintered in vacuum at 1460° C. for 60 minutes when the sheet and the pins become fully dense. See FIG. 3.

The sintered carbide sheet is then attached to a sand core using Aremco's "CERAMABOND" 569 and the core/sheet is heated in an oven at 100° C. to drive out the moisture from the binder and cure it. It may also be dried at room temperature provided sufficiently long curing time is allowed. The cast iron is cast around the sheet using the conventional casting practice such that, on metal solidification, the carbide sheet is firmly attached to the casting surface.

While the invention has been described in terms of various preferred embodiments, the skilled artisan will appreciate the various modifications, substitutions, omissions, and changes which may be made without departing from the spirit thereof. Accordingly, it is intended that the scope of the present invention be defined solely by the scope of the following claims including equivalents thereof.

What is claimed:

1. A cast metal product having a wear-resistant material surface layer on a surface thereof wherein (a) the surface layer comprises a wear-resistant material and which material is metallurgically bonded to the metal and, (b) the wear-resistant layer is mechanically bonded to the surface of the metal by way of (i) a plurality of pins which pins comprise the wear-resistant material and are integrally attached to the wear-resistant layer and (ii) a textured pattern on the surface of the wear resistant layer which pattern is effective to resist shear forces.

2. The product according to claim 1 wherein the metal comprises iron and the wear-resistant material is a carbide.

3. The product according to claim 2 wherein the carbide comprises tungsten carbide or chromium carbide.

4. The product according to claim 3 wherein the wear-resistant material further includes a metallic binder.

5. The product according to claim 1, wherein the product is produced by providing a wear-resistant layer in the form of a sintered sheet having both a waffle shaped textured pattern and the plurality of pins on a surface thereof;

attaching the wear-resistant layer onto a mold surface; and casting a metal melt so as to provide the metal product.

6. A cast metal product having a wear-resistant surface layer on a surface thereof wherein (a) the wear-resistant layer comprises a material which is not metallurgically reactive with the metal, and, (b) the wear-resistant layer is mechanically bonded to the surface of the metal by way of (i) a plurality of pins which pins comprise the wear-resistant material and are integrally attached to the wear-resistant layer, and (ii) a textured pattern on the surface of the wear-resistant layer which pattern is effective to resist shear forces.

7. The product according to claim 6 wherein the metal product is formed by casting and where, prior to casting, the wear-resistant layer has a waffle pattern on the surface to which the pins are attached.

8. The product according to claim 6 wherein the product is produced by providing a wear-resistant layer in the form of a sintered sheet having the plurality of pins integrally attached onto the surface thereof;

attaching the wear-resistant layer to a mold surface; and casting a metal melt so as to provide the metal product.

9. The product according to claim 1 wherein the textured pattern is a waffle pattern.

10. The product according to claim 6 wherein the textured pattern is a waffle pattern.

11. The product according to claim 2 wherein the metal is ductile iron.

* * * * *